US010096928B2

(12) United States Patent
Shimizu

(10) Patent No.: US 10,096,928 B2
(45) Date of Patent: Oct. 9, 2018

(54) CONNECTOR

(71) Applicant: Yazaki Corporation, Minato-ku, Tokyo (JP)

(72) Inventor: Tomohiko Shimizu, Makinohara (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 15/864,094

(22) Filed: Jan. 8, 2018

(65) Prior Publication Data

US 2018/0205176 A1 Jul. 19, 2018

(30) Foreign Application Priority Data

Jan. 13, 2017 (JP) ..... 2017-003977

(51) Int. Cl.
*H01R 13/436* (2006.01)
*H01R 13/629* (2006.01)
*H01R 13/52* (2006.01)

(52) U.S. Cl.
CPC ..... *H01R 13/4361* (2013.01); *H01R 13/5219* (2013.01); *H01R 13/62938* (2013.01)

(58) Field of Classification Search
CPC ..... H01R 13/4361
See application file for complete search history.

(56) References Cited

U.S. PATENT DOCUMENTS

| | | | | |
|---|---|---|---|---|
| 6,547,594 | B2 | 4/2003 | Ichio et al. | |
| 6,659,797 | B2 | 12/2003 | Ichio | |
| 9,666,970 | B2 | 5/2017 | Kida | |
| 9,680,256 | B1 * | 6/2017 | Lane | H01R 13/6275 |
| 2002/0123260 | A1 | 9/2002 | Ichio | |
| 2014/0378006 | A1 * | 12/2014 | Pade | H01R 13/436 439/752 |
| 2017/0025780 | A1 | 1/2017 | Kida | |

FOREIGN PATENT DOCUMENTS

| | | | |
|---|---|---|---|
| JP | 2002-329554 | A | 11/2002 |
| JP | 2015-195124 | A | 11/2015 |

* cited by examiner

*Primary Examiner* — James Harvey
(74) *Attorney, Agent, or Firm* — Banner & Witcoff, Ltd.

(57) ABSTRACT

A connector having a connector housing, the connector includes a columnar terminal accommodating portion that is provided with a terminal accommodating chamber accommodating terminals therein and a hood portion that surrounds an outer circumferential surface of the terminal accommodating portion to have a gap between the hood portion and the outer circumferential surface so that a fitting tube of a mating connector is fitted into the gap, and is formed with a retainer insertion opening serving as an insertion port of a retainer locking the terminals in the terminal accommodating chamber. In the connector, the retainer insertion opening has an opening inner-edge surface facings in a fitting direction toward the mating connector, and the opening inner-edge surface is recessed in a direction opposite to the fitting direction and a center part of the opening inner-edge surface is most recessed.

4 Claims, 7 Drawing Sheets

CONNECTOR

CROSS REFERENCE TO RELATED APPLICATION

This application is based on Japanese Patent Application No. 2017-003977 filed on Jan. 13, 2017, the contents of which are incorporated herein by reference.

BACKGROUND

1. Technical Field

The present invention relates to a connector including a hood portion in which a retainer insertion opening serving as an insertion port of a retainer is formed.

2. Background Art

In the related art, as a connector provided with a waterproof structure, there is known a connector including a connector housing provided with a columnar terminal accommodating portion in which a terminal accommodating chamber for receiving a terminal is formed, and a hood portion surrounding an outer circumferential surface of the terminal accommodating portion while having a gap between the hood portion and the outer circumferential surface so that a fitting tube of a mating connector is fitted into the gap.

For example, JP-A-2002-329554 discloses a connector formed with a locking arm in a hood portion so that the connector is fitted and locked to a mating connector.

In addition, JP-A-2015-195124 discloses a connector in which a housing lock arm is supported at both ends thereof by an arm supporting portion so as to lock a retainer at a temporary lock position and a main lock position.

In the above-described connectors disclosed in JP-A-2002-329554 and JP-A-2015-195124, a retainer insertion opening is formed in the hood portion, the retainer insertion opening serving as an insertion port of the retainer, which locks the terminal into the terminal accommodating chamber.

However, in a case where an external force is applied to the connector housing to cause an inwardly inclined portion in the retainer insertion opening when the connector housing is formed or when the connector is fitted to the mating connector, in the connector formed with the retainer insertion opening in the hood portion of the connector housing, a tip end of the fitting tube of the mating connector may bump into the opening inner-edge surface of the retainer insertion opening.

As a result, the bumping may become an obstacle to a fitting operation of the connector to the mating connector.

The present invention has been made in consideration of the above matter, and an object thereof is to provide a connector capable of preventing a mating connector in the middle of fitting from bumping into an opening inner-edge surface of a retainer insertion opening due to an inward inclination of the retainer insertion opening.

SUMMARY OF THE INVENTION (1) According to an aspect of the invention, a connector having a connector housing includes:

a columnar terminal accommodating portion that is provided with a terminal accommodating chamber accommodating terminals therein; and a hood portion that surrounds an outer circumferential surface of the terminal accommodating portion to have a gap between the hood portion and the outer circumferential surface so that a fitting tube of a mating connector is fitted into the gap, and is formed with a retainer insertion opening serving as an insertion port of a retainer locking the terminals in the terminal accommodating chamber, wherein the retainer insertion opening has an opening inner-edge surface facings in a fitting direction toward the mating connector, and the opening inner-edge surface is recessed in a direction opposite to the fitting direction and a center part of the opening inner-edge surface is most recessed.

(2) The connector of the configuration (1) further includes a fitting assist lever that is capable of using a lever to apply a force for fitting of the connector to the mating connector.

(3) In the connector of the configuration (1), the opening inner-edge surface may have a predetermined curvature.

(4) In the connector of the configuration (1), the opening inner-edge surface may be inclined with respect to a direction orthogonal to the fitting direction.

According to the connector of the configuration (1) of the present invention, since the retainer insertion opening is formed such that the opening inner-edge surface, which faces the tip end surface of the fitting tube of the mating connector in the fitting direction of the connector to the mating connector, is recessed in the direction opposite to the fitting direction from the both ends toward the center part while forming an R-shaped surface or an inclined surface in which the center part is the lowermost portion, the inwardly inclined center part is positioned further rear side in the insertion direction with respect to the fitting tube compared to the both ends which are hardly inwardly inclined, the tip end of the fitting tube is, first, with respect to the opening inner-edge surface, positioned below the both ends without bumping into the both ends of the opening inner-edge surface when the connector moves in the fitting direction, and thus the tip end of the fitting tube is inserted into the lower side of the opening inner-edge surface without bumping into the opening inner-edge surface. Therefore, it is possible to prevent the mating connector in the middle of fitting from bumping into the opening inner-edge surface of the retainer insertion opening due to the inward inclination of the retainer insertion opening.

According to the connector of the configuration (2) of the present invention, since the connector includes the fitting assist lever being capable of using the lever to apply a force for fitting of the connector to the mating connector, even in a case where it is necessary to apply an excessive force to the connector housing for fitting of the connector to the mating connector, it is possible to reduce the work burden of the operator. Furthermore, since the opening inner-edge surface is formed to be recessed in the direction opposite to the fitting direction from the both ends toward the center part while forming an R-shaped surface or an inclined surface in which the center part is the lowermost portion, even when an excessive force is applied to the connector housing by the fitting assist lever for fitting, it is possible to prevent the mating connector from bumping into the opening inner-edge surface, thereby preventing the connector or the mating connector from being broken.

DETAILED DESCRIPTION OF THE EMBODIMENT

Hereinafter, a preferred embodiment of a connector according to the present invention will be described with reference to the drawings.

Figure 1A:
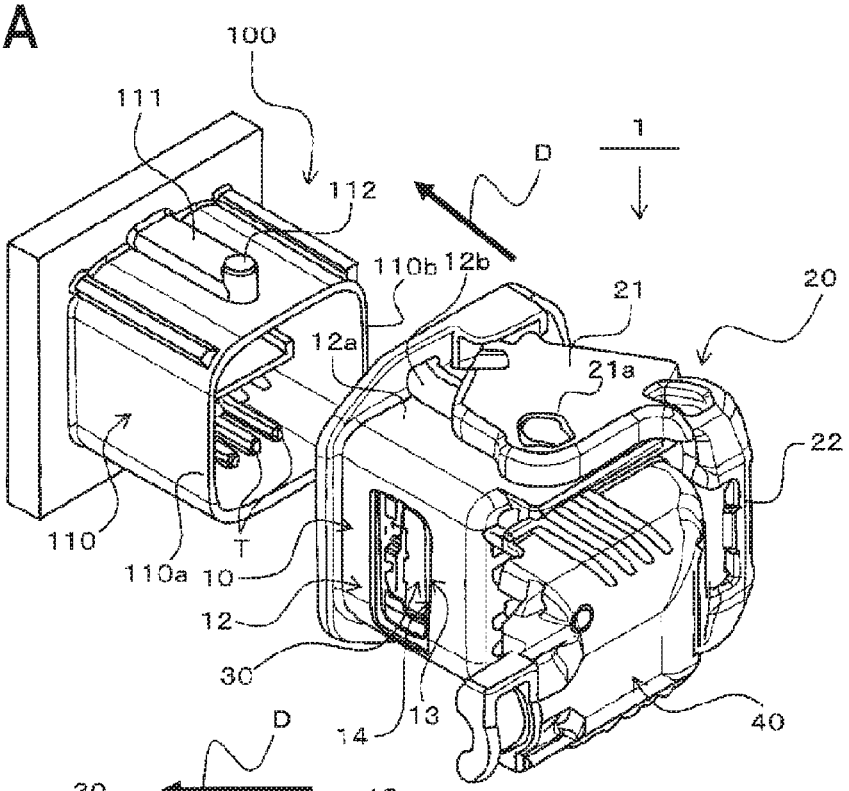
FIG. 1A is a perspective view illustrating a connector according to an embodiment of the present invention and is a perspective view illustrating a mating connector which is fitted into the connector.
Figure 1B:
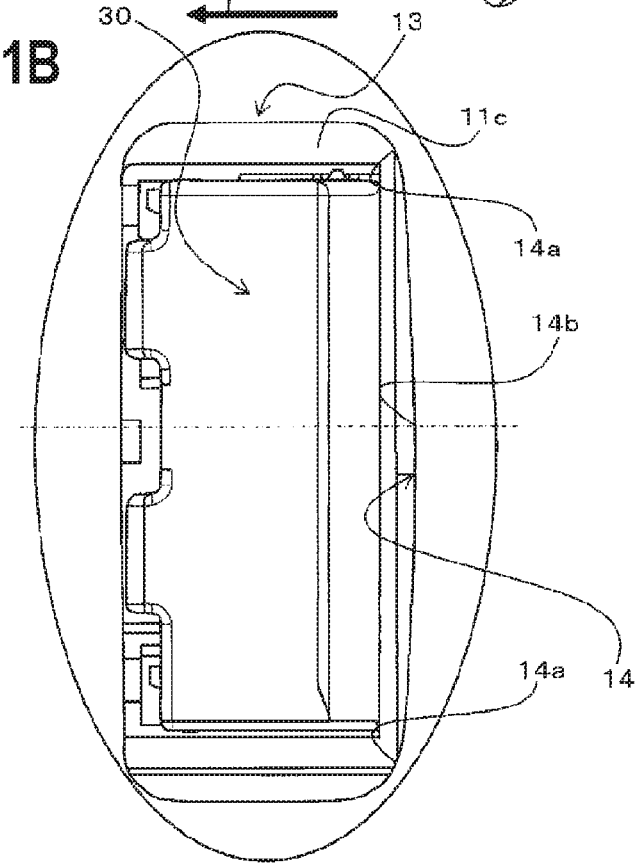
FIG. 1B is an enlarged view illustrating the vicinity of a retainer insertion opening of the connector illustrated in FIG. 1A.
Figure 2:
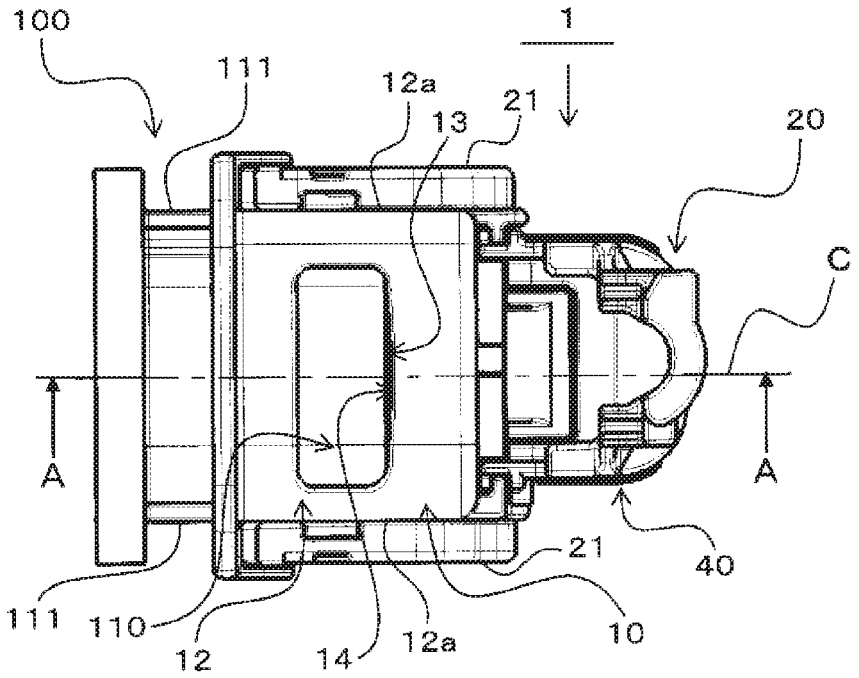
FIG. 2 is a view illustrating the connector in the middle of fitting to the mating connector when viewed from a side of the retainer insertion opening.
Figure 3A:
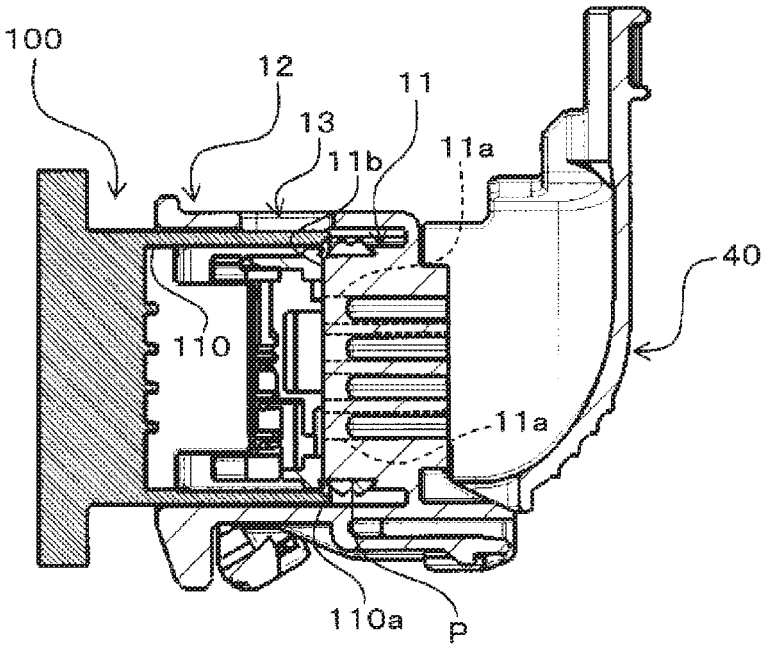
FIG. 3A is a sectional view illustrating the connector in the middle of fitting to the mating connector taken along a line A-A illustrated in FIG. 2.
Figure 3B:
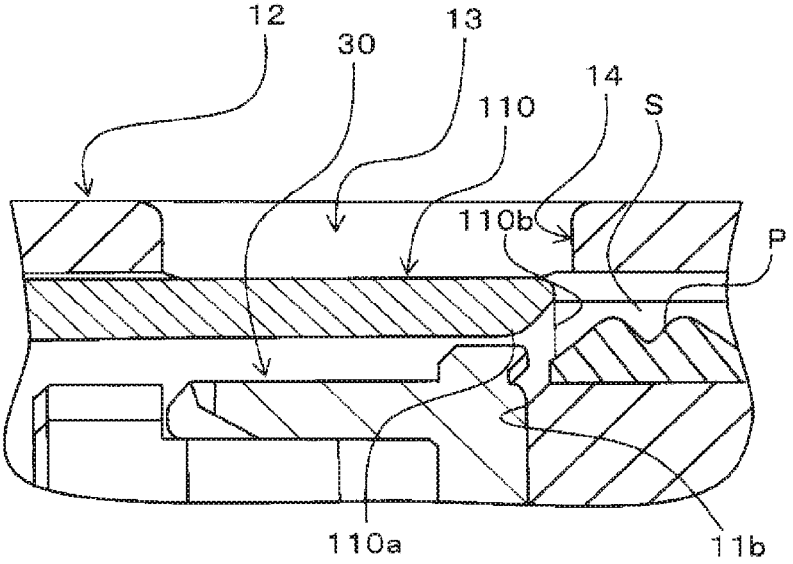
FIG. 3B is an enlarged view illustrating the vicinity of the retainer insertion opening of the connector illustrated in FIG. 3A.
Figure 4A:
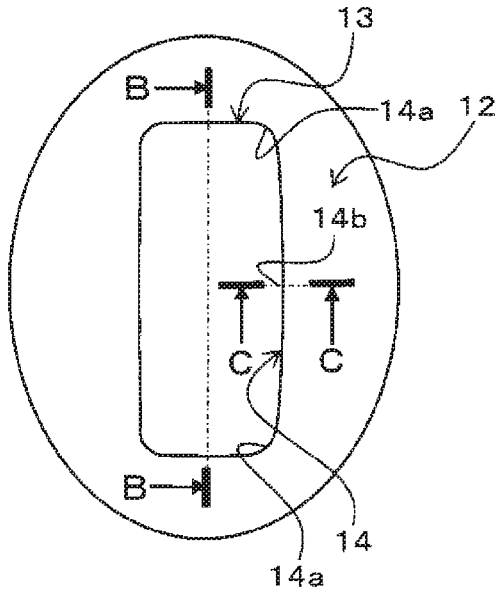
FIG. 4A is a view illustrating the retainer insertion opening of the connector.
Figure 4B:
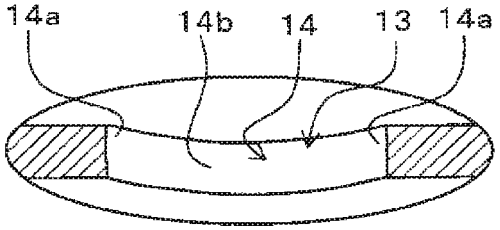
FIG. 4B is a sectional view illustrating the vicinity of the retainer insertion opening taken along a line B-B illustrated in FIG. 4A and illustrating a state where the retainer insertion opening is inwardly inclined.
Figure 4C:
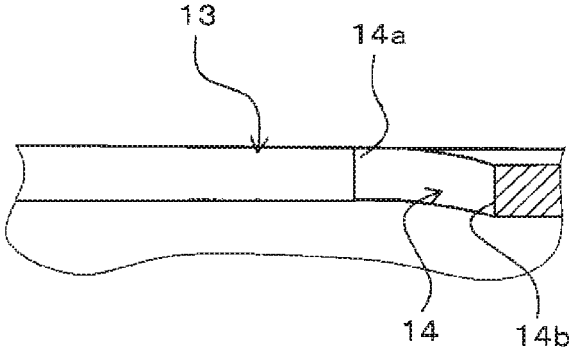
FIG. 4C is a sectional view illustrating the vicinity of the retainer insertion opening taken along a line C-C illustrated in FIG. 4A and illustrating the state where the retainer insertion opening is inwardly inclined.

FIG. 1A is a perspective view illustrating a connector 1 according to an embodiment of the present invention and is a perspective view illustrating a mating connector 100 which is fitted into the connector 1, and FIG. 1B is an enlarged view illustrating the vicinity of a retainer insertion opening 13 of the connector 1 illustrated in FIG. 1A. FIG. 2 is a view illustrating the connector 1 in the middle of fitting to the mating connector 100 when viewed from a side of the retainer insertion opening 13. FIG. 3A is a sectional view illustrating the connector in the middle of fitting to the mating connector 100 taken along a line A-A illustrated in FIG. 2, and FIG. 3B is an enlarged view illustrating the vicinity of the retainer insertion opening 13 of the connector 1 illustrated in FIG. 3A. FIG. 4A is a view illustrating the retainer insertion opening 13 of the connector 1, FIG. 4B is a sectional view illustrating the vicinity of the retainer insertion opening 13 taken along a line B-B illustrated in FIG. 4A and illustrating a state where the retainer insertion opening 13 is inwardly inclined, and FIG. 4C is a sectional view illustrating the vicinity of the retainer insertion opening 13 taken along a line C-C illustrated in FIG. 4A and illustrating the state where the retainer insertion opening 13 is inwardly inclined.

Here, the description on terminals and wires is omitted in FIGS. 3A and 3B.

The connector 1 according to the embodiment of the invention includes a connector housing 10, a fitting assist lever 20 which assists a fitting operation of the connector to the mating connector 100, a retainer 30 which locks the terminals (not illustrated) into a terminal accommodating chamber 11*a* of the connector housing 10, and a cover 40 which closes a wire outlet.

The connector housing 10 is formed of an insulating resin and includes a terminal accommodating portion 11 and a hood portion 12.

The terminal accommodating portion 11 has a columnar shape protruding toward a fitting direction D and is formed with a plurality of partitioned terminal accommodating chambers 11*a* which accommodate the terminals therein.

The terminal accommodating portion 11 is formed such that a retainer insertion hole 11*b* for inserting the retainer 30 is positioned to face the retainer insertion opening 13 to be described, as illustrated in FIGS. 3A and 3B.

The hood portion 12 surrounds an outer circumferential surface 11*c* of the terminal accommodating portion 11 to have a gap S between the outer circumferential surface 11*c* and the hood portion 12 so that a fitting tube 110 of the mating connector 100 is fitted into the gap S, and is formed with the retainer insertion opening 13 serving as the insertion port of the retainer 30.

The retainer insertion opening 13 is formed in a manner that a part of a wall 12*a* configuring one side surface of the hood portion 12 is opened.

As illustrated in FIG. 1B, the retainer insertion opening 13 is formed such that an opening inner-edge surface 14, which faces a tip end surface 110*b* of the fitting tube 110 of the mating connector 100 in the fitting direction D of the connector to the mating connector 100, is recessed in a direction opposite to the fitting direction D from both end portions 14*a* and 14*a* toward a center part 14*b* of the opening inner-edge surface 14 while forming an R-shaped surface in which the center part 14*b* is the lowermost portion.

The retainer insertion opening 13 in the embodiment is arranged in the hood portion 12 to have a center line of the opening coincident with a center line C in a width direction of the fitting tube 110 of the mating connector 100.

In the hood portion 12, a pair of fitting guide slits 12*b* and 12*b* (see FIG. 1A) are formed to extend in the fitting direction D so as to guide a pair of fitting guide ribs 111 and 111 formed on the facing walls of the fitting tube 110 of the mating connector 100.

The fitting assist lever 20 is capable of using the lever to apply a force for fitting of the connector to the mating connector 100.

The fitting assist lever 20 includes a pair of rotating main bodies 21 and 21, which are rotatably attached with a rotating fulcrum 21*a* on the outer surfaces of the facing walls of the hood portion 12 where the fitting guide slits 12*b* and 12*b* are formed, and an operation lever 22, which connects portions of the respective rotating main bodies 21 and 21 away from the rotating fulcrum 21*a* in a bridging manner.

Each of the rotating main bodies 21 and 21 is formed, on the inner surface thereof, with a fitting guide groove (not illustrated) into which a fitting guide protrusion 112 to be described of the mating connector 100 is fitted.

A rotating operation with the rotating fulcrum 21*a* is performed using the operation lever 22 in the fitting assist lever 20 configured as above, whereby a force for fitting generated by the lever acts on the connector housing 10.

The retainer 30 is inserted into the connector housing 10 through the retainer insertion opening 13 and the retainer insertion hole 11*b* to be locked to the connector housing 10 at two positions of a temporary lock position where the respective terminals can be inserted into the terminal accommodating chamber 11*a* and a main lock position where the retainer is allowed to be positioned in the connector housing 10 further inwardly compared to the temporary lock position in order to lock the respective terminals into the terminal accommodating chamber 11*a*.

The cover 40 is attached to the connector housing 10 to cover the almost entire surface of the connector housing 10 on the wire outlet side, and has functions to close the wire outlet and to guide a plurality of wires connected to the respective terminals in a predetermined direction.

Next, the mating connector 100 will be described.

The mating connector 100 includes the fitting tube 110 that is a portion to be fitted into the connector 1, and a plurality of mating terminals T to be connected to the plurality of terminals of the connector 1 are disposed in the tube at positions corresponding to the respective terminals.

In the mating connector 100, fitting guide protrusions 112 are provided at terminal ends of the pair of fitting guide ribs 111, respectively.

The pair of the fitting guide protrusions 112 are fitted into the fitting guide grooves (not illustrated) of the respective rotating main bodies 21 so that a force for fitting generated by operating the lever in the fitting assist lever 20 is transmitted to the protrusions.

The connector 1 and the mating connector 100 are fitted in such a manner that the fitting tube 110 of the mating connector 100 is inserted into the gap S formed between the terminal accommodating portion 11 and the hood portion 12 of the connector 1 to be waterproof sealed by an elastic sealing member P (see FIGS. 3A and 3B) attached to the outer circumferential surface 11*c* of the terminal accommodating portion 11.

Next, a procedure of fitting of the connector 1 to the mating connector 100 and operations of the respective portions until the connector 1 is completely fitted to the mating connector 100 will be described using FIGS. 5A to 5D.

FIGS. 5A to 5D are views explaining how the connector 1 is fitted to the mating connector 100 by the operation of the operation lever 22.

Figure 5A:
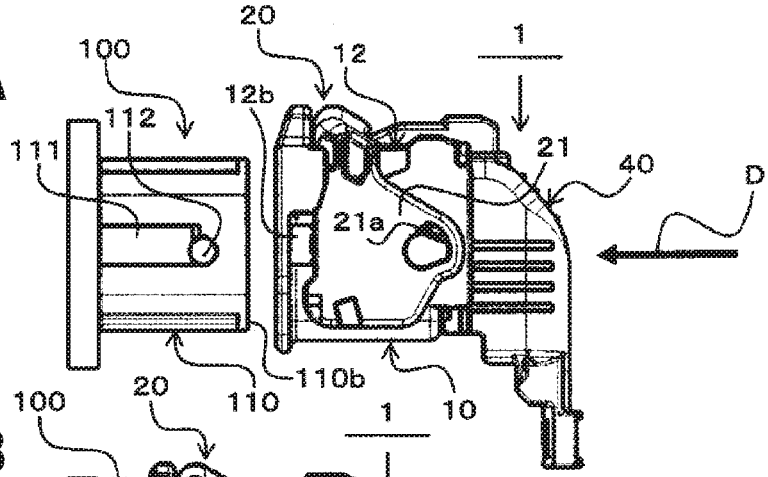
FIGS. 5A to 5D are views explaining how the connector is fitted to the mating connector by an operation of an operation lever.

First, an operator starts moving the connector 1 in the fitting direction D while aligning the insertion port of the connector 1 with the insertion port of the mating connector 100 (see FIG. 5A).

Here, the pair of fitting guide ribs 111 and 111 of the mating connector 100 are fitted into the pair of fitting guide slits 12*b* and 12*b* of the connector 1 so that the connector 1 is guided to move along the fitting direction D.

Figure 5B:
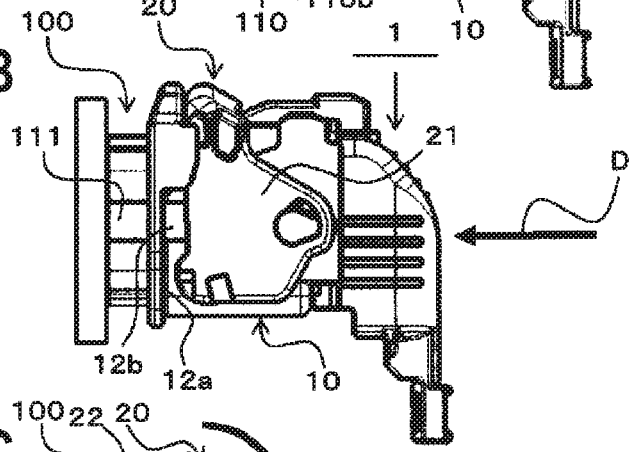

Next, when the operator moves the connector 1 further in the fitting direction D, the pair of fitting guide protrusions 112 and 112 of the mating connector 100 are fitted into the fitting guide grooves (not illustrated) formed on the inner surface of the fitting assist lever 20 (see FIG. 5B).

Figure 5C:
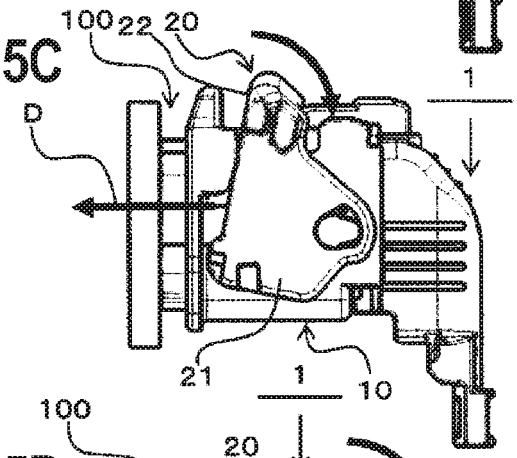

Subsequently, the operator starts the rotating operation of the operation lever 22, and moves the connector 1 further in fitting direction D using the lever of the fitting assist lever 20 (see FIG. 5C).

Figure 5D:
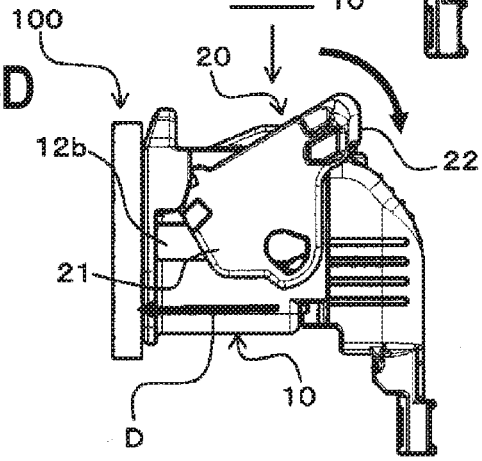

Lastly, the operator continues the rotating operation of the operation lever 22 until the operation complete position, and thus the fitting of the connector 1 to the mating connector 100 is completed (see FIG. 5D).

In this manner, the connector 1 is configured such that a force required for fitting can be applied to the connector housing 10 through the fitting assist lever 20 even when the operator does not apply an excessive force to the connector housing 10 for fitting, in order to move the connector 1 in the fitting direction D using the lever of the fitting assist lever 20.

That is, even in a case where it is necessary to apply an excessive force to the connector housing 10 for fitting of the connector 1 to the mating connector 100, it is possible to reduce the work burden of the operator.

An operation of the connector 1 will be described by which a tip end 110*a* of the fitting tube 110 is prevented from bumping into the inwardly inclined opening inner-edge surface 14 of the retainer insertion opening 13.

Figure 6A:
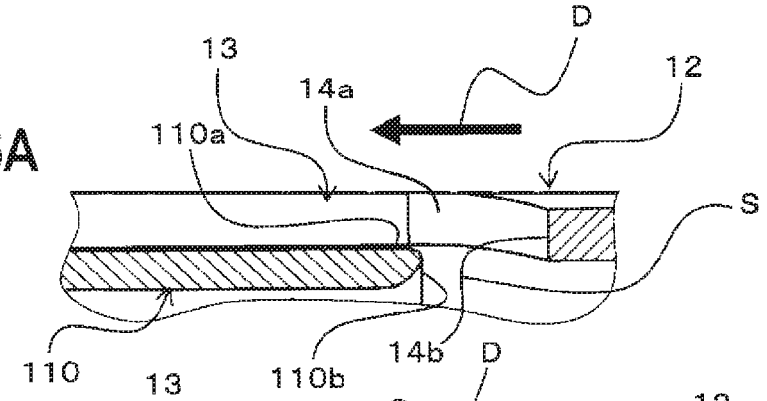
FIGS. 6A to 6C are views explaining an operation of the connector by which a tip end of a fitting tube is prevented from bumping into an inwardly inclined opening inner-edge surface of the retainer insertion opening.
Figure 6B:
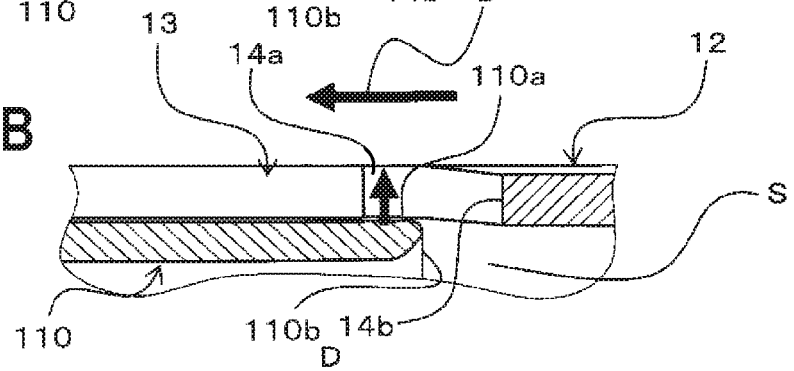
Figure 6C:
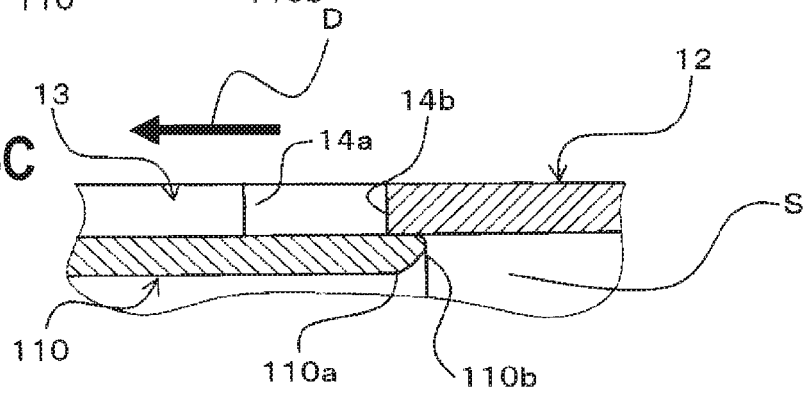

FIGS. 6A to 6C are views explaining the operation of the connector 1 by which a tip end 110*a* of the fitting tube 110 is prevented from bumping into the inwardly inclined opening inner-edge surface 14 of the retainer insertion opening 13.

When a force for moving the connector in the fitting direction D is applied to the connector housing 10, the opening inner-edge surface 14, which faces the tip end surface 110*b* of the fitting tube 110 of the mating connector 100, is inwardly inclined, as illustrated in FIGS. 4B and 4C.

Here, in the opening inner-edge surface 14, the both end portions 14*a* and 14*a* are hardly inwardly inclined and the center part 14*b* is inwardly inclined most significantly.

The opening inner-edge surface 14 is formed to be recessed in the direction opposite to the fitting direction D from the both end portions 14*a* and 14*a* toward the center part 14*b* while forming an R-shaped surface in which the center part 14*b* is the lowermost portion. For this reason, the inwardly inclined center part 14*b* is to be positioned further rear side in the insertion direction with respect to the fitting tube 110 of the mating connector 100 compared to the both end portions 14*a* and 14*a* which are hardly inwardly inclined.

More specifically, the opening inner-edge surface 14 is formed to be positioned gradually rear side in the direction opposite to the fitting direction D from the both end portions 14*a* and 14*a* which are hardly inwardly inclined toward the center part 14*b* inwardly inclined most significantly.

Therefore, with respect to the opening inner-edge surface 14, the tip end 110*a* of the fitting tube 110 of the mating connector 100 is moved to be positioned below the both end portions 14*a* and 14*a* without bumping into the both end portions 14*a* and 14*a* of the opening inner-edge surface 14 when the connector 1 moves in the fitting direction D (see FIG. 6A).

Accordingly, the tip end 110*a* of the fitting tube 110 of the mating connector 100 is inserted into the lower side of the opening inner-edge surface 14 without bumping into the opening inner-edge surface 14.

Then, the tip end 110*a* of the fitting tube 110 of the mating connector 100 is moved to the inside of the hood portion 12 in the state of being inserted into the lower side of the opening inner-edge surface 14 (see FIG. 6B).

At this time, since the tip end 110*a* of the fitting tube 110 is already set on the lower side of the opening inner-edge surface 14 from the both end portions 14*a* and 14*a* of the opening inner-edge surface 14, the tip end is moved to the further inside of the hood portion 12 while pushing up the portion, which is gradually inwardly inclined as being close to the center part 14*b* of the opening inner-edge surface 14, to a regular position before being inwardly inclined.

After that, the tip end 110*a* of the fitting tube 110 of the mating connector 100 is moved to the inside of the hood portion 12 to pass the lower side of the opening inner-edge surface 14 while pushing up the inwardly inclined portion to the regular position even at the center part 14*b* of the opening inner-edge surface 14 (see FIG. 6C).

In this manner, the tip end 110*a* of the fitting tube 110 of the mating connector 100 is inserted until the fitting complete position without bumping into the opening inner-edge surface 14.

In the connector 1 according to the embodiment of the present invention, since the retainer insertion opening 13 is formed such that the opening inner-edge surface 14, which faces the tip end surface 110*b* of the fitting tube 110 of the mating connector 100 in the fitting direction D of the connector to the mating connector 100, is recessed in the direction opposite to the fitting direction D from the both end portions 14*a* and 14*a* toward the center part 14*b* while forming an R-shaped surface in which the center part 14*b* is the lowermost portion, the inwardly inclined center part 14*b* is positioned further rear side in the insertion direction with respect to the fitting tube 110 compared to the both end portions 14*a* and 14*a* which are hardly inwardly inclined, the tip end 110*a* of the fitting tube 110 is, first, with respect to the opening inner-edge surface 14, positioned below the both end portions 14*a* and 14*a* without bumping into the both end portions 14*a* and 14*a* of the opening inner-edge surface 14 when the connector 1 moves in the fitting direction D, and thus the tip end 110*a* of the fitting tube 110 is inserted into the lower side of the opening inner-edge surface 14 without bumping into the opening inner-edge surface 14. Therefore, it is possible to prevent the mating connector 100 in the middle of fitting from bumping into the opening inner-edge surface 14 of the retainer insertion opening 13 due to the inward inclination of the retainer insertion opening 13.

In addition, since the connector 1 according to the embodiment of the present invention includes the fitting assist lever 20 being capable of using the lever to apply a force for fitting of the connector to the mating connector 100, even in a case where it is necessary to apply an excessive force to the connector housing 10 for fitting of the connector 1 to the mating connector 100, it is possible to reduce the work burden of the operator. Furthermore, since the opening inner-edge surface 14 is formed to be recessed in the direction opposite to the fitting direction D from the both end portions 14*a* and 14*a* toward the center part 14*b* while forming an R-shaped surface in which the center part 14*b* is the lowermost portion, even when an excessive force is applied to the connector housing 10 by the fitting assist lever 20 for fitting, it is possible to prevent the mating connector 100 from bumping into the opening inner-edge surface 14, thereby preventing the connector 1 or the mating connector 100 from being broken.

Modification

Next, a modification of the retainer insertion opening 13 according to the embodiment of the present invention will be described using FIG. 7.

Figure 7:
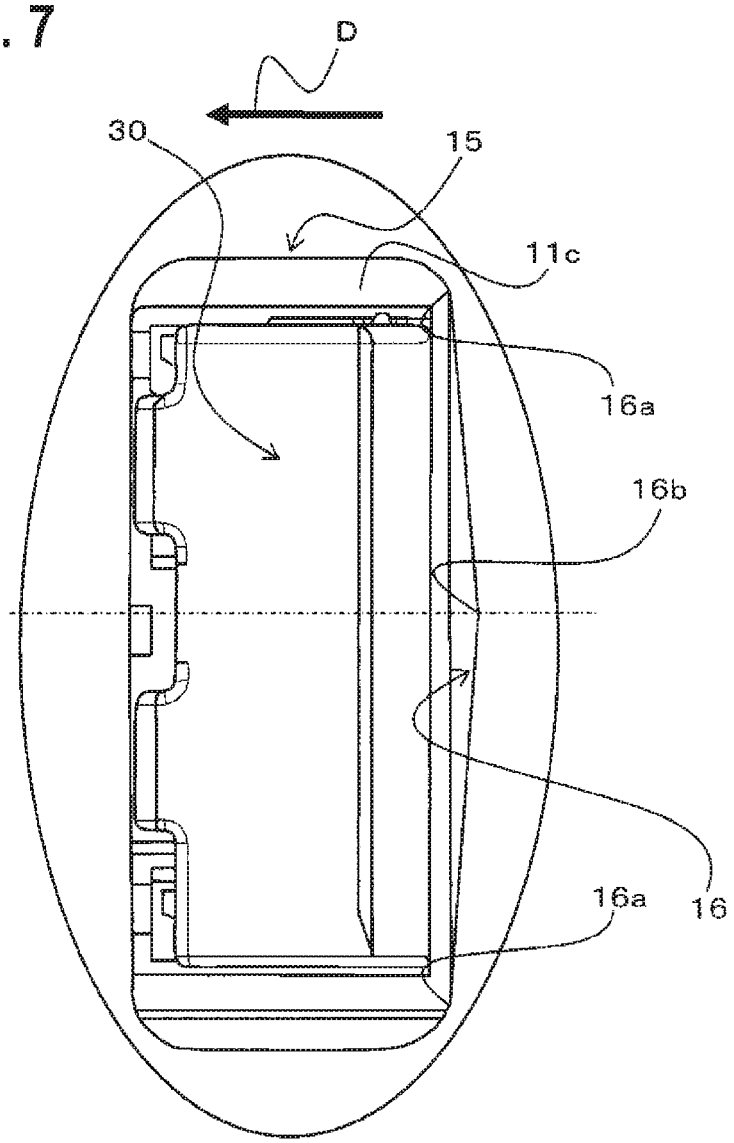
FIG. 7 is a view illustrating a retainer insertion opening according to a modification.

FIG. 7 is a view illustrating a retainer insertion opening of the modification.

A retainer insertion opening 15 of the modification is different from the retainer insertion opening 13 in that it is formed such that an opening inner-edge surface 16 is recessed in a direction opposite to the fitting direction D from both ends 16*a* and 16*a* toward a center part 16*b* while forming an inclined surface in which the center part 16*b* is the lowermost portion.

The other configurations are the same as those of the embodiment, and the same components as the embodiment are denoted by the same reference numerals and the description thereof will not repeated.

The retainer insertion opening 15 is formed such that inner-edge surface 16, which faces the tip end surface 110*b* of the fitting tube 110 of the mating connector 100 in the fitting direction D of the connector to the mating connector 100, is recessed in the direction opposite to the fitting direction D from the both ends 16*a* and 16*a* toward the center part 16*b* while forming an inclined surface in which the center part 16*b* is the lowermost portion.

For this reason, in the opening inner-edge surface 16, the most significantly inwardly inclined center part 16*b* is positioned further rear side in the insertion direction with respect to the fitting tube 110 compared to the both ends 16*a* and 16*a* which are hardly inwardly inclined.

In the retainer insertion opening 15 of the modification, the tip end 110*a* of the fitting tube 110 is, first, with respect to the opening inner-edge surface 16, positioned below the both ends 16*a* and 16*a* without bumping into the both ends 16*a* and 16*a* of the opening inner-edge surface 16 when the connector 1 moves in the fitting direction D, and thus the tip end 110*a* of the fitting tube 110 is inserted into the lower side of the opening inner-edge surface 16 without bumping into the opening inner-edge surface 16. Therefore, it is possible to prevent the mating connector 100 in the middle of fitting from bumping into the opening inner-edge surface 16 of the retainer insertion opening 15 due to the inward inclination of the retainer insertion opening 15, similarly to the retainer insertion opening 13 of the embodiment.

Hitherto, the invention made by the inventors has been described in specific based on the above-described embodiment of the invention. However, the present invention is not limited to the above-described embodiment of the invention, and can be applied in various modifications without departing from the spirit and range of the invention.

What is claimed is:

1. A connector having a connector housing, the connector comprising:

a columnar terminal accommodating portion that is provided with a terminal accommodating chamber accommodating terminals therein; and a hood portion that surrounds an outer circumferential surface of the terminal accommodating portion to have a gap between the hood portion and the outer circumferential surface so that a fitting tube of a mating connector is fitted into the gap, and is formed with a retainer insertion opening serving as an insertion port of a retainer locking the terminals in the terminal accommodating chamber, wherein the retainer insertion opening has an opening inner-edge surface facing in a fitting direction toward the mating connector, and the opening inner-edge surface is recessed in a direction opposite to the fitting direction and a center part of the opening inner-edge surface is most recessed.

2. The connector according to claim 1, further comprising:

a fitting assist lever that is capable of using a lever to apply a force for fitting of the connector to the mating connector.

3. The connector according to claim 1, wherein the opening inner-edge surface has a predetermined curvature.

4. The connector according to claim 1, wherein the opening inner-edge surface is inclined with respect to a direction orthogonal to the fitting direction.

* * * * *